United States Patent [19]

Brand et al.

[11] 4,431,195

[45] Feb. 14, 1984

[54] STOCK MARKET TRANSACTION BOARD GAME

[76] Inventors: Donald L. Brand; Molly C. Brand; George Brand, all of 171 W. Jeffrey Pl., Columbus, Ohio 43214

[21] Appl. No.: 383,704

[22] Filed: Jun. 1, 1982

[51] Int. Cl.[3] ..... A63F 3/00

[52] U.S. Cl. ..... 273/256

[58] Field of Search ..... 273/256, 278, 254, 242, 273/243, 249

[56] References Cited

U.S. PATENT DOCUMENTS

| | | | |
|---|---|---|---|
| 2,673,738 | 3/1954 | Jenkins | 273/256 |
| 2,970,840 | 2/1961 | Richie | 273/243 |
| 3,163,423 | 12/1964 | Jackson | 273/256 |
| 3,559,993 | 2/1971 | Thomas | 273/278 |
| 3,698,718 | 10/1972 | Kuhn | 273/254 |
| 3,770,277 | 11/1973 | Cass | 273/278 |
| 3,799,552 | 3/1974 | Lefevre et al. | 273/256 |

FOREIGN PATENT DOCUMENTS

| | | | |
|---|---|---|---|
| 1212217 | 11/1970 | United Kingdom | 273/256 |

*Primary Examiner*—Richard C. Pinkham

*Assistant Examiner*—Matthew L. Schneider

*Attorney, Agent, or Firm*—Walter H. Schneider

[57] ABSTRACT

A board game comprising a game board divided into a plurality of horizontally and vertically disposed rows of squares, the horizontal rows constituting a game track extending from one corner of the board to the diagonally opposite corner. The squares represent companies the stocks of which are traded between players and between players and the board, the squares being divided into debit and credit sides. Special security transaction squares are also provided on the game board for transactions between players or between players and the board. A portfolio card is provided for each player, the surface of which reflects the companies appearing on the game board so that each player can keep a record of his stock portfolio. The game is further provided with accessory pieces in the form of markers to record players movement across the track of the board; a pair of dice in response to the roll of which movement of a marker is made; stock certificates of the companies represented on the game board; simulated currency for engaging in stock transactions; and debit and credit cards used in one of the special security transactions.

3 Claims, 2 Drawing Figures

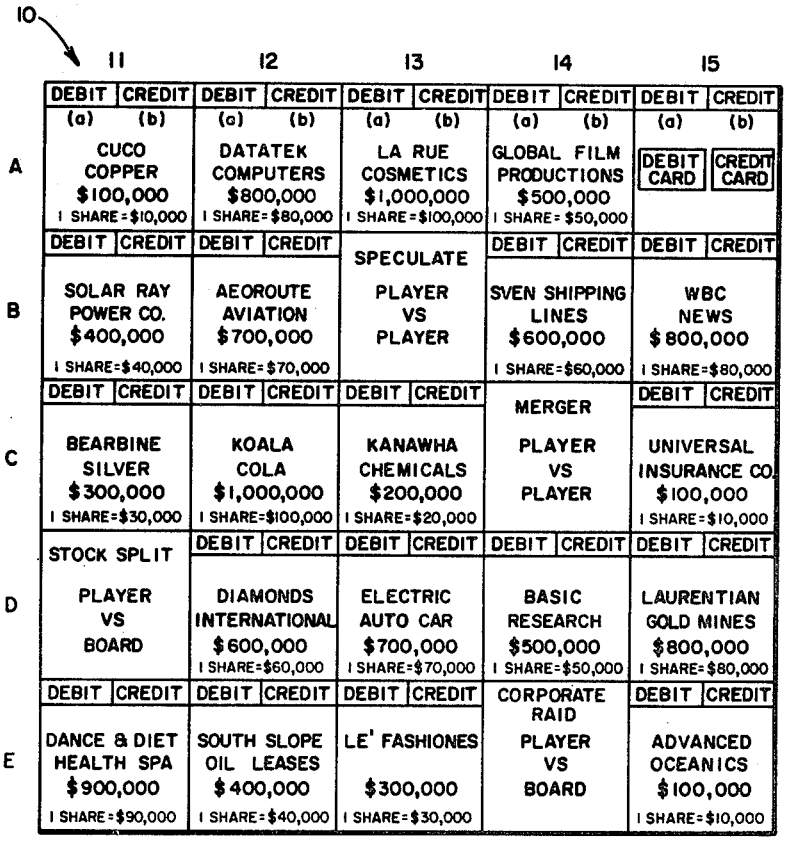

10

| | 11 | 12 | 13 | 14 | 15 |
|---|---|---|---|---|---|
| A | DEBIT CREDIT (a) (b) CUCO COPPER $100,000 1 SHARE=$10,000 | DEBIT CREDIT (a) (b) DATATEK COMPUTERS $800,000 1 SHARE=$80,000 | DEBIT CREDIT (a) (b) LA RUE COSMETICS $1,000,000 1 SHARE=$100,000 | DEBIT CREDIT (a) (b) GLOBAL FILM PRODUCTIONS $500,000 1 SHARE=$50,000 | DEBIT CREDIT (a) (b) DEBIT CARD CREDIT CARD |
| B | DEBIT CREDIT SOLAR RAY POWER CO. $400,000 1 SHARE=$40,000 | DEBIT CREDIT AEOROUTE AVIATION $700,000 1 SHARE=$70,000 | SPECULATE PLAYER VS PLAYER | DEBIT CREDIT SVEN SHIPPING LINES $600,000 1 SHARE=$60,000 | DEBIT CREDIT WBC NEWS $800,000 1 SHARE=$80,000 |
| C | DEBIT CREDIT BEARBINE SILVER $300,000 1 SHARE=$30,000 | DEBIT CREDIT KOALA COLA $1,000,000 1 SHARE=$100,000 | DEBIT CREDIT KANAWHA CHEMICALS $200,000 1 SHARE=$20,000 | MERGER PLAYER VS PLAYER | DEBIT CREDIT UNIVERSAL INSURANCE CO. $100,000 1 SHARE=$10,000 |
| D | STOCK SPLIT PLAYER VS BOARD | DEBIT CREDIT DIAMONDS INTERNATIONAL $600,000 1 SHARE=$60,000 | DEBIT CREDIT ELECTRIC AUTO CAR $700,000 1 SHARE=$70,000 | DEBIT CREDIT BASIC RESEARCH $500,000 1 SHARE=$50,000 | DEBIT CREDIT LAURENTIAN GOLD MINES $800,000 1 SHARE=$80,000 |
| E | DEBIT CREDIT DANCE & DIET HEALTH SPA $900,000 1 SHARE=$90,000 | DEBIT CREDIT SOUTH SLOPE OIL LEASES $400,000 1 SHARE=$40,000 | DEBIT CREDIT LE' FASHIONES $300,000 1 SHARE=$30,000 | CORPORATE RAID PLAYER VS BOARD | DEBIT CREDIT ADVANCED OCEANICS $100,000 1 SHARE=$10,000 |

FIG. 1

20

| | 21 | 22 | 23 | 24 |
|---|---|---|---|---|
| | PLAYER PORTFOLIO CARD | | | |
| F | CUCO COPPER<br>1 SHARE=$10,000 | DATATEK COMPUTERS<br>1 SHARE=$80,000 | LA RUE COSMETICS<br>1 SHARE=$100,000 | GLOBAL FILM PRODUCTIONS<br>1 SHARE=$50,000 |
| G | SOLAR RAY POWER CO.<br>1 SHARE=$40,000 | AEOROUTE AVIATION<br>1 SHARE=$70,000 | SVEN SHIPPING LINES<br>1 SHARE=$60,000 | WBC NEWS<br>1 SHARE=$80,000 |
| H | BEARBINE SILVER<br>1 SHARE=$30,000 | KOALO COLA<br>1 SHARE=$100,000 | KANAWHA CHEMICALS<br>1 SHARE=$20,000 | UNIVERSAL INSURANCE CO.<br>1 SHARE=$10,000 |
| I | DIAMONDS INTERNATIONAL<br>1 SHARE=$60,000 | ELECTRIC AUTO CAR<br>1 SHARE=$70,000 | BASIC RESEARCH<br>1 SHARE=$50,000 | LAURENTIAN GOLD MINES<br>1 SHARE=$80,000 |
| J | DANCE & DIET HEALTH SPA<br>1 SHARE=$90,000 | SOUTH SLOPE OIL LEASES<br>1 SHARE=$40,000 | LE' FASHIONES<br>1 SHARE=$30,000 | ADVANCED OCEANICS<br>1 SHARE=$10,000 |

FIG. 2

STOCK MARKET TRANSACTION BOARD GAME

BACKGROUND OF THE INVENTION

1. Field of the Invention

The present invention relates to board games. More particularly, the present invention relates to a board game in which each participant endeavors to acquire the most valuable stock portfolio as he moves a marker across a playing board in response to the scores of thrown dice.

2. Description of the Prior Art

The prior art is replete with board games, including board games in which the object is to accumulate the most valuable portfolio of various types of assets. The stock market has been a favorite basis for such games, the participants engaging in the trading of shares in simulated publicly owned companies, as in actual stock market transactions, in response to directions dictated by the chance roll of dice, spin of a pointer, selection of a card, or the like. U.S. Pat. Nos. 2,526,300, 3,163,424, 3,397,890, 3,770,277 and 3,779,522, for instance, show a number of board games of differing concepts and designs all of which have the stock market as a common basis, and the accumulation of assets through stock transactions as a common object. Board games of the stock market variety are usually proclaimed to be of simple concept and design, and intended for all ages of participants. Too often, however, such games are found to be too complex to stimulate interest in younger aged participants or too simple to challenge the more intellectual, or found to comprise too many game board accessories which become misplaced during the playing of the game or lost between the playing of games, or found to require too extensive a period of playing time to determine a winner thereby losing participant interest.

SUMMARY OF THE INVENTION

The principal object of this invention is to provide an improved board game based generally on the concept of trading in securities, as in actual stock market transactions, and whose object is the aquisition of the most valuable stock portfolio. A further object of this invention is to provide a board game based on the securities industry which is sufficiently simple in concept and playing rules as to be attractive to participants of a young age while, at the same time, being sufficiently challenging to hold the attention of more intellectual participants. A still further object of this invention is to provide a stock market board game comprising a playing board having a minimum of board accessories and which, in toto, can be easily and inexpensively manufactured.

To this end, the present invention comprises a game board the surface of which is divided so as to provide a plurality of horizontally and vertically arranged rows of squares or sections. Except for one square in each horizontal row, each square on the game board represents a company in which the shares of stock may be bought and sold, the excepted squares each representing a special type of securities transaction other than a straight buy/sell transaction. Each company square, moreover, is further divided vertically so as to provide a debit side and a credit side. As an accessory piece to the game board, there are provided a plurality of player portfolio cards on which each player can record his stock assets, the surface of each player portfolio card conforming to that of the game board except that the company squares are not divided into debit and credit sides, and no special securities transaction squares are provided. As additional accessories to the game board there are provided a pair of dice and a plurality of markers, one for each player, by which each player can record his movement across the game board in response to scores rolled with the dice. Other accessory pieces include simulated currency for use in transactions involving stocks of the various companies listed on the game board; cards, or other forms of share ownership such as plastic discs, representing shares in the various company stocks; and debit and credit cards which will be more fully discussed hereinafter.

DESCRIPTION OF THE DRAWINGS

FIG. 1 is a plan view of the game board in accordance with this invention.

FIG. 2 is a plan view of one of the player portfolio cards used as an accessory to the game board of FIG. 1.

DESCRIPTION OF THE PREFERRED EMBODIMENT

Referring to FIG. 1 of the drawing, reference numeral 10 denotes the game board of this invention the surface of which is divided into a plurality of horizontally and vertically disposed rows of squares indicated horizontally as A-E incl., and vertically as 11–15 incl. The total number of squares on the surface of game board 10 may, of course, vary but for purposes of the description of the invention herein constitute 25 in number as shown in FIG. 1. Each horizontal row of squares is made up of four company squares, for example, A-11, A-12, A-13, and A-14 in the top row, and one special securities transaction square, for example, square A-15. Each company square carries within its borders the name of a fictitious publicly held corporation, together with its stated capital and the authorized number of shares of par dollar value. Each company square, moreover, is divided by a vertically extending line to provide a debit side and a credit side, for example, A-11a to A-14a, and A-11b to A-14b, respectively. Each special securities transaction square carries within its borders a designation of the type of transaction it relates to and except with respect to square A-15, whether it is a "Player-Player" transaction or a "Player-Board" transaction. Unlike the other special transaction squares, square A-15 is divided into debit and credit sides similar to the company squares, for reasons which will be subsequently discussed.

Referring to FIG. 2, reference numeral 20 denotes a player portfolio card, of which there is one provided for each game playing participant. The surface of card 20 is divided into horizontally disposed rows of squares F-J incl. and vertically disposed rows of squares 21–24. The purpose of portfolio card 20 is simply to provide a means for each player to keep a record of the results of his stock purchases and sales made during the progress of the game and, accordingly, only company squares appear on the portfolio card without debit and credit sides. Each company square on portfolio card 20 corresponds to a company square on board 10, corresponding squares containing within their borders the same information concerning the company represented by the square.

The board game of this invention further includes, as accessory pieces to board 10, a marker for each participant to record his progress across the track of board 10, a pair of dice, preferably of contrasting colors, for determining the movement of each marker, simulated currency in suitable denominations for use in security transactions during the course of the game, and stock certificates in the form of plastic discs or the like, representing shares of issued stock in each company represented on board 10. These accessory pieces may take any conventional form suitable for conducting the game and, accordingly, they have not been illustrated in the drawing. Also included as an accessory piece are debit and credit cards for use in conducting the special security transaction of square A-15 of board 10. These cards comprise a debit card and a credit card for each company appearing on board 20, the name of the company appearing on one side of the card, the reverse side having the caption "Debit" or "Credit", as the case may be. As with the other board accessories, the debit and credit cards are conventional in design and can simply be rectangularly shaped cards as used for various purposes in many games. For this reason they also have not been illustrated in the drawings.

In initiating the game of this invention, ten plastic discs, or the like, representing stock certificates, are placed on the credit side of each company displayed on board 10, the ten discs totaling the stated authorized capital of the particular company, each disc further representing an equal share of the capital. Each participant is given an initial sum of simulated currency which, of course, may vary in amount, but for the descriptive purposes herein constitutes a total of $500,000. The balance of the simulated currency is held by the Board which is represented by one of the players. Each player is also given a marker which is placed at the edge of Square A-11 for the start of the game. The debit and credit cards used in conjunction with special transaction square A-15 are placed face down on a surface outside the playing surface of board 10 in separate stacks, and are put under the control of the Board representative.

The order of play is determined by any suitable means and is maintained throughout the duration of the game. The participant selected to commence the game moves his marker horizontally across the rows of squares, i.e., from A-11 to A-15, then B-11 to B-15, etc., in response to the total score of the dice he has thrown. Each debit and credit side of each company square and of special transaction square A-15 counts for one point of the total score of the dice, as does each special transaction square B-13, C-14, D-11, and E-14. When a participant has completed the game track from A-11 to E-15, the track is renegotiated starting again at square A-11. Should a participant in his journey from square A-11 to square E-15 fall upon the credit side of one of the company squares, he is entitled to purchase from the Board one share of stock of the company in question for the price stated on board 10, provided, of course, that an outstanding share is still held by the Board, and provided further that the participant has the purchase price, or can arrange to acquire the purchase price in a transaction with another participant. If the transaction is completed the number of discs representing the shares involved in the transaction are moved from the company square on board 10 to the corresponding company square on the player's portfolio card 20. In the event that a participant's marker falls on the debit side of a company square, the participant must, provided he owns a share of the stock of the company in question, sell one share back to the Board for the share price stated on board 10.

Should a player during the course of the game land, by virtue of his dice roll, on one of the special security transaction squares A-15(a)or(b), B-13, C-14, D-11, or E-14, the special transaction is conducted as follows:

A-15 Debits and Credits Transaction—Depending on whether the player lands on the debit or credit side of square A-15, he will draw a debit or credit card. If he does not have on his portfolio card 20 at least one share of stock of the company listed on the drawn card, then no transaction is conducted and the game proceeds. If, on the other hand, the participant does own at least one share of the company stock in question, he will roll the white die of the contrasting colored dice and multiply by $10,000 the number appearing on the rolled die to obtain a total dollar amount. If his drawn card is a credit card, he is paid the total amount in cash by the Board. If the drawn card is a debit card, the player is required to pay the total amount to the Board. If the player is unable to pay the total amount from his cash assets, and is unable to raise sufficient cash in transactions with other player, or is unable to settle with the Board through the sale to the Board of shares of another company, which shares the Board must accept in settlement of the debt, then the player's continued participation in the game is terminated, and the game continues without him.

B-13 Speculative Transaction—A player landing upon special transaction square B-13 has the option to challenge any other player for "all or nothing" of the shares that each owns in different companies. The challenging player may select any player and the companies that will form the basis of the speculative transaction, but the challenged player is not obligated to accept the challenge. In the event that the challenged player accepts, the high score of each player's roll of the white die determines the winner who acquires all of the shares that the loser has in the selected company. The player landing on square B-13 is not obligated to challenge nor, if he does, is the challenged player obligated to accept the challenge. If there is no challenge, or if there is and it is not accepted, the game proceeds without further delay.

C-14 Merger Transaction—The special transaction of square C-14 is similar to that of B-13 except that the "all or nothing" challenge involves stock in the same company. The challenging player may select the company to form the subject of the transaction as well as the other player, but the latter need not accept if he owns all 10 shares of the company involved. If the challenge is accepted, the winner of the transaction is determined by the high serve of the white die roll as in the B-13 speculative transaction. If no challenge is extended or, if extended not accepted because the challenged player owns all the shares in the company involved, then the game proceeds without further delay.

D-11 Stock Split Transaction—A player landing upon square D-11 may, at his option, challenge one share of a company of his choice held in his portfolio against half of the remaining shares held by the Board in the same company. The direction in which the transaction will proceed is determined by the high die score of two contrasting colored dice rolled by the player. If the high score is on the colored die, the player must sell his one share of stock to the Board at the price listed on board 10. If the high score is on the white die, the player may purchase one-half of the remaining shares in the company held by the Board at the stated price of board 10. If the number of shares held by the Board is an odd number, the player may purchase the odd share. If a cash transaction cannot be effected by the player, he has the option of offering shares of equal value in another company or companies, which offer must be accepted by the Board. If the player elects not to enter the transaction or, having entered and won the roll of the dice elects not to consummate the transaction, the game continues without further delay.

E-14 Corporate Raid Transaction—The E-14 special transaction is similar to that of the D-11 stock split transaction except that the player can win all of the Board-held shares in the involved company or, on the other hand, lose to the Board all shares he holds in the same company. The winner is determined by high score of a roll of the contrasting colored dice. The player need not enter the transaction nor consummate it if he enters and wins. All exchanges of shares are at the stated price of board 10, and the player may tender shares of equal value in other companies in lieu of cash.

Stock transactions may be entered into at any time by two players involving shares of the same or different companies and at prices that may be the same or different from those appearing on board 10. In special transactions involving a player and the Board in which the player has the option to purchase shares from the Board, the transaction can be completed by the offering of consideration by the player in the form of cash or in the form of shares of other companies which are of equal or greater value, a cash settlement being made by the Board with the player if the value is greater.

The game may be played by any number of participants but is best suited for 3 or 4 persons. In addition to the version of the game as above described, the game may also be played in a shortened version in which neither currency nor debit and credit cards are used. In the shortened game, stock transactions are simply made through the exchange of shares without cash consideration being paid the seller. Square A-15, Debits and Credits, transaction is ignored except that it continues to be used to determine movement of participant's markers. The winner of the game in either version is the player who has accumulated the most valuable stock portfolio in a predetermined period of time, or who first attains stock control of all companies on board 10, whichever is first reached.

What is claimed is:

1. A stock market game for two or more players comprising: (a) a game board the surface of which has delineated thereon the outline of a game square whose area is subdivided into a plurality of squares constituting horizontally and vertically disposed rows of squares, the horizontal rows of squares constituting a game track which follows successive rows from top to bottom and from one corner to the opposite diagonal corner of said game square; (b) a company name, stated capital and number and par value of shares of stock marked in each square except for at least one square in each horizontal row in which has been marked a special securities transaction involving one or more of the companies designated in said company squares; (c) delineation in each of said company squares subdividing each such square into debit and credit areas adapted to receive stock certificate representations, each such area being appropriately marked; (d) a portfolio card for each player the surface of which is subdivided into company squares corresponding to those of the game square, said card being used by each player to record his current stock portfolio; (e) a marker for each player to record his movement over the track of the game square; (f) a pair of dice of contrasting colors for use in determining each player's movement over the game square track and for engagement in securities transactions; (g) simulated currency for player engagement in securities transactions; and (h) a stock certificate representation for each share of stock of each company represented on each company square.

2. A stock market game according to claim 1 in which each horizontal row of squares has more company squares than special securities transaction squares, and the special securities transaction squares in adjacent horizontal rows of squares are not in the same vertical row of squares.

3. A stock market game according to claim 2 in which a special securities transaction square in at least one of said horizontal rows of squares is subdivided into debit and credit areas, and separate debit and credit cards are provided for each company identified in each company square.

* * * * *